US007695206B2

(12) United States Patent
Kawakami et al.

(10) Patent No.: US 7,695,206 B2
(45) Date of Patent: Apr. 13, 2010

(54) PRINTER WITH A PEELER MECHANISM

(75) Inventors: Hideki Kawakami, Hata-machi (JP); Masahiko Yamada, Omi-mura (JP)

(73) Assignee: Seiko Epson Corporation (JP)

( * ) Notice: Subject to any disclaimer, the term of this patent is extended or adjusted under 35 U.S.C. 154(b) by 708 days.

(21) Appl. No.: 11/317,335

(22) Filed: Dec. 23, 2005

(65) Prior Publication Data

US 2006/0165467 A1 Jul. 27, 2006

(30) Foreign Application Priority Data

Dec. 27, 2004 (JP) ..... 2004-375694

(51) Int. Cl.
*B41J 29/54* (2006.01)
*B41J 29/56* (2006.01)
*E05C 9/00* (2006.01)

(52) U.S. Cl. ..... 400/663; 400/664; 400/668; 400/693; 292/44; 292/101; 292/194; 292/203

(58) Field of Classification Search ..... 400/693, 400/663–664, 668; 292/44–45, 101, 108, 292/194, 203
See application file for complete search history.

(56) References Cited

U.S. PATENT DOCUMENTS

| | | | | |
|---|---|---|---|---|
| 5,980,138 | A | 11/1999 | Shiozaki et al. | |
| 6,609,844 | B1 * | 8/2003 | Petteruti et al. | 400/88 |
| 6,916,052 | B2 * | 7/2005 | Yamada et al. | 292/44 |
| 7,197,344 | B2 * | 3/2007 | Ahn et al. | 455/575.1 |
| 2005/0121146 | A1 * | 6/2005 | Leonard et al. | 156/350 |

FOREIGN PATENT DOCUMENTS

| | | |
|---|---|---|
| JP | 11-001045 | 1/1999 |
| JP | 2002-348010 | 12/2002 |
| JP | 2005-96290 | 4/2005 |

OTHER PUBLICATIONS

European Search Report which issued in the corresponding EP application No. 05 027 313.5-1251, citing the above reference.

* cited by examiner

*Primary Examiner*—Judy Nguyen
*Assistant Examiner*—Marissa L Ferguson-Samreth
(74) *Attorney, Agent, or Firm*—Baker & Hostetler, LLP

(57) ABSTRACT

A printer having an opening/closing cover for providing access to a roll paper compartment, a peeler mechanism for peeling printed labels from a web and for dispensing the peeled printed labels from the printer and an opening and closing mechanism 50 which locks and unlocks the cover and a peeler unit 10 of the peeler mechanism in response to the manual operation of a manual operating member such as a release button 17 with a single easy operation. When the release button 17 is depressed into a first operating position 17B, a lock lever 52 of the opening/closing mechanism 50 slides from a locked position 52A to a released position 52B to disengage the lock lever 52 thus unlocking the opening/closing cover 9. At the same time, the sliding lock lever 52 pushes engaging claws 74*a*, 73*a* that lock or unlocks the peeler unit 10. When the cover release button 17 is further depressed into a second operating position 17C, the lock lever 52 swings and a cover-lifting surface 54 on the lock lever 52 pushes the opening/closing cover 9 up causing the unlocked opening/closing cover 9 to move into a raised open position. Simply pushing the cover release button 17 thus unlocks and raises the opening/closing cover 9, and unlocks the peeler unit 10.

14 Claims, 12 Drawing Sheets

PRINTER WITH A PEELER MECHANISM

BACKGROUND OF THE INVENTION

1. Field of the Invention

The present invention relates to a peeler mechanism for peeling printed labels from a web, and relates more particularly to a printer having a peeler mechanism for dispensing printed labels. More particularly, the present invention is a printer having a peeler mechanism composed of an opening/closing cover that can be opened and closed to load roll paper having label paper wound in a roll into a roll paper compartment, and a peeler unit that can be opened and closed to open and close the web discharge path of the peeler mechanism, and relates specifically to an opening/closing mechanism for locking the opening/closing cover and peeler unit in a closed position to the printer and releasing the opening/closing cover and peeler unit from this closed and locked position.

2. Description of Related Art

Some printers that print to roll paper delivered from paper wound in a roll have a paper feed roller for conveying the roll paper assembled to an opening/closing cover that opens and closes the roll paper compartment so that when the opening/closing cover is closed the roll paper can be conveyed from the roll paper compartment by the paper feed roller. Opening the opening/closing cover of this printer opens the roll paper compartment and also raises the paper feed roller assembled to the opening/closing cover, thus providing wide, open access to the roll paper transportation path. By thus opening the roll paper transportation path, roll paper can be easily loaded into the printer for printing by placing the roll paper into the roll paper compartment, pulling a specific length of paper off the roll, and then simply closing the opening/closing cover.

To prevent the opening/closing cover from being accidentally opened by the operator, a lock mechanism locks the opening/closing cover in the position closed to the printer. This lock mechanism has an engagement portion disposed to the opening/closing cover, and a lock lever disposed to the printer. The lock lever can swing in the front-back direction of the printer, and a spring or other urging member causes the lock lever to engage the engagement portion of the closed opening/closing cover from the front or back side, thereby locking the opening/closing cover in the closed position.

Thermal printers, that is, printers having a thermal print head, print by holding the thermal head against a thermal paper to expose the paper to heat produced by the thermal head. When the opening/closing cover is closed, the platen roller (paper feed roller) attached to the cover and the thermal head on the printer side are urged together. The roll paper is thus held between the platen roller and the thermal head for printing. Opening the opening/closing cover thus requires releasing the lock mechanism of the opening/closing cover and lifting the cover up and opening against this urging force.

If the lock mechanism of the opening/closing cover is separate from the mechanism for raising and opening the opening/closing cover, opening the cover requires releasing the lock mechanism from the locked position and then a separate operation for lifting and opening the opening/closing cover by the opening mechanism. The opening/closing cover thus cannot be opened by a single operation, and operation is tedious and inconvenient. Opening the opening/closing cover is simplified, however, by linking operation of the lock mechanism to the cover opening mechanism so that the opening mechanism automatically raises and opens the cover when the lock mechanism is released. However, if these mechanisms are thus linked and the lock mechanism is accidentally released by impact or vibration, the opening/closing cover will undesirably open. This is particularly a problem if the cover thus opens during printing because printing cannot proceed.

To solve this problem, in Japanese Unexamined Patent Application 2005-96290 we previously disclosed a locking and unlocking mechanism for an opening/closing cover. This locking and unlocking mechanism can open and close an opening/closing cover with a single action, and can hold the opening/closing cover in the closed position without being affected by external factors such as impact and vibration.

Printers that print on roll paper can also be used to print labels by using roll label paper. Such label paper has labels of a specific length adhesively attached to a web which is wound into a roll. Such label printers may also have a peeler mechanism for peeling the printed labels from the web disposed near the label discharge opening. So that paper jams can be easily corrected and the label paper can be easily loaded to the label transportation path, this peeler mechanism preferably has an openable peeler unit rendered so that opening the peeler unit also opens the web transportation path.

When an openable/closable peeler unit is thus disposed to the peeler mechanism and an opening/closing cover that opens and closes the roll paper compartment is also provided, a lock mechanism and an unlocking mechanism must be provided for both the peeler unit and this opening/closing cover, and separate operations are required to open and close the peeler unit and the opening/closing cover. Furthermore, printer size and cost increase undesirably because these mechanism are not compact. Yet further, if the opening and closing operations are not simple, printer operability also decreases undesirably.

To solve the foregoing problems, the present invention compactly renders a locking and unlocking mechanism for the peeler unit and opening/closing cover, and enables opening both the peeler unit and opening/closing cover by a simple operation. The invention also affords a printer with a peeler mechanism having an opening/closing mechanism that can hold the opening/closing cover in the closed position without being affected by external factors such as shock and vibration.

SUMMARY OF THE INVENTION

A printer with a peeler mechanism according to a first aspect of the invention has an opening/closing cover that opens and closes a roll paper storage compartment; a peeler unit that opens and closes a peeler mechanism for peeling labels from a web; a first lock member for locking the opening/closing cover in a closed position; a manual operating member for releasing the opening/closing cover from being locked by the first lock member; a second lock member for locking the peeler unit in a closed position; and a pivot mechanism for pivoting the first lock member by the manual operating member; wherein pivoting the pivot mechanism moves the second lock member and unlocks the peeler unit.

The manual operating member in this aspect of the invention first moves the first lock member and thus unlocks the opening/closing cover. The first lock member then pivots by a pivot mechanism and raises the opening/closing cover and the second lock member moves and unlocks the peeler unit. A simple operation thus releases and opens the opening/closing cover and then continues to unlock the peeler unit.

A printer with a peeler mechanism according to a second aspect of the invention has an opening/closing cover that opens and closes a roll paper storage compartment; a peeler unit that opens and closes a peeler mechanism for peeling labels from a web; a first lock member for locking the opening/closing cover in a closed position; a manual operating member for releasing the opening/closing cover from being locked by the first lock member; a second lock member for locking the peeler unit in a closed position; and a linear movement mechanism for moving the first lock member linearly by the manual operating member. The linear movement mechanism moves the first lock member and unlocks the opening/closing cover.

The first lock member in this aspect of the invention moves linearly between positions for locking and releasing (unlocking) the opening/closing cover. The opening/closing cover can thus be held in the locked position with more strength than when the first lock member swings forward and back in an arc to lock and unlock the opening/closing cover. When the cover is locked by an engagement pin fitting into an engagement channel, the depth of engagement is greater when the members slide together in a straight line than when the members are engaged along a curved path. The members thus lock together more firmly and are not unlocked by external vibration and impact.

A printer with a peeler mechanism according to another aspect of the invention has an opening/closing cover that opens and closes a roll paper storage compartment; a peeler unit that opens and closes a peeler mechanism for peeling labels from a web; a first lock member for locking the opening/closing cover in a closed position, and having a linear movement mechanism and a pivot mechanism; a second lock member for locking the peeler unit in a closed position; and a manual operating member that moves from an initial position through a first operating position to a second operating position. When the manual operating member moves from the initial position to the first operating position, the linear movement mechanism linearly moves the first lock member and unlocks the opening/closing cover, and when the manual operating member moves from the first operating position to the second operating position, the pivot mechanism pivots the first lock member, moves the second lock member, and unlocks the peeler unit.

In this aspect of the invention a single continuous action of the manual operating member continuously unlocks and opens the opening/closing cover and then unlocks the peeler unit when the manual operating member is in a specific position.

In another aspect of the invention the second lock member is preferably disposed to the opening/closing cover and can lock the peeler unit in the closed position when the opening/closing cover is locked in the closed position.

When thus comprised the peeler unit cannot be locked in the closed position if only the peeler unit is closed. This prevents forgetting to close the opening/closing cover. Furthermore, a single sensor for detecting if the peeler unit is locked in the closed position can be used to detect the open or closed state of both the opening/closing cover and peeler unit.

The second lock mechanism for locking the peeler unit may be represented by the racks of a rack and pinion assembly. More particularly, a pair of racks may be used to function as the second lock mechanism with the pair of racks moving reciprocally along a linear path and meshing with a pinion that rotates around a fixed point. The pinion can be rendered to the opening/closing cover such that when one rack is pushed by the first lock member, the other rack moves linearly in the opposite direction. If the pair of racks extend widthwise to the printer, the rack assembly expands and contracts in the same widthwise direction. Engaging holes are also formed in the widthwise side portions of the peeler unit, and the outside ends of the racks pass from the inside to the outside of the peeler unit through these holes with the pair of racks unlocked from the engaging holes when one rack is pushed.

When the manual operating member of the printer with a peeler mechanism according to the present invention is operated, the first lock member that locks the opening/closing cover that closes the roll paper compartment moves in a straight line to unlock and thus release the opening/closing cover. At the same time this first lock member pushes against a second lock member that locks the peeler unit closed, and thus unlocks the second lock member. Continued operation of the manual operating member after the opening/closing cover is unlocked causes the first lock member to pivot and push the opening/closing cover up and open. Unlocking and opening the opening/closing cover can thus be completed in a single continuous action.

A single continuous operation of the manual operating member can thus unlock both the opening/closing cover and peeler unit, and can push the opening/closing cover up and open. The opening/closing cover and peeler unit can thus be easily opened.

Furthermore, because the first lock member pushes the second lock member and unlocks the peeler unit, a separate mechanism for unlocking the peeler unit is not needed, and a compact unlocking mechanism for the opening/closing cover and peeler unit can be provided.

Yet further, because the first lock member for locking the opening/closing cover moves linearly between the locked and unlocked positions, the locked position can be held with greater strength than in a conventional arrangement in which the lock member swings in an arc between the locked and unlocked positions. Therefore, while the mechanism of the present invention enables the operations of unlocking the opening/closing cover and pushing the opening/closing cover up and open to be simply completed in a single continuous action, the opening/closing cover is also prevented from being accidentally opened by external shocks or vibrations.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A printer with a peeler mechanism according to a preferred embodiment of the present invention is described below with reference to the accompanying figures.

General Configuration

Figure 1:
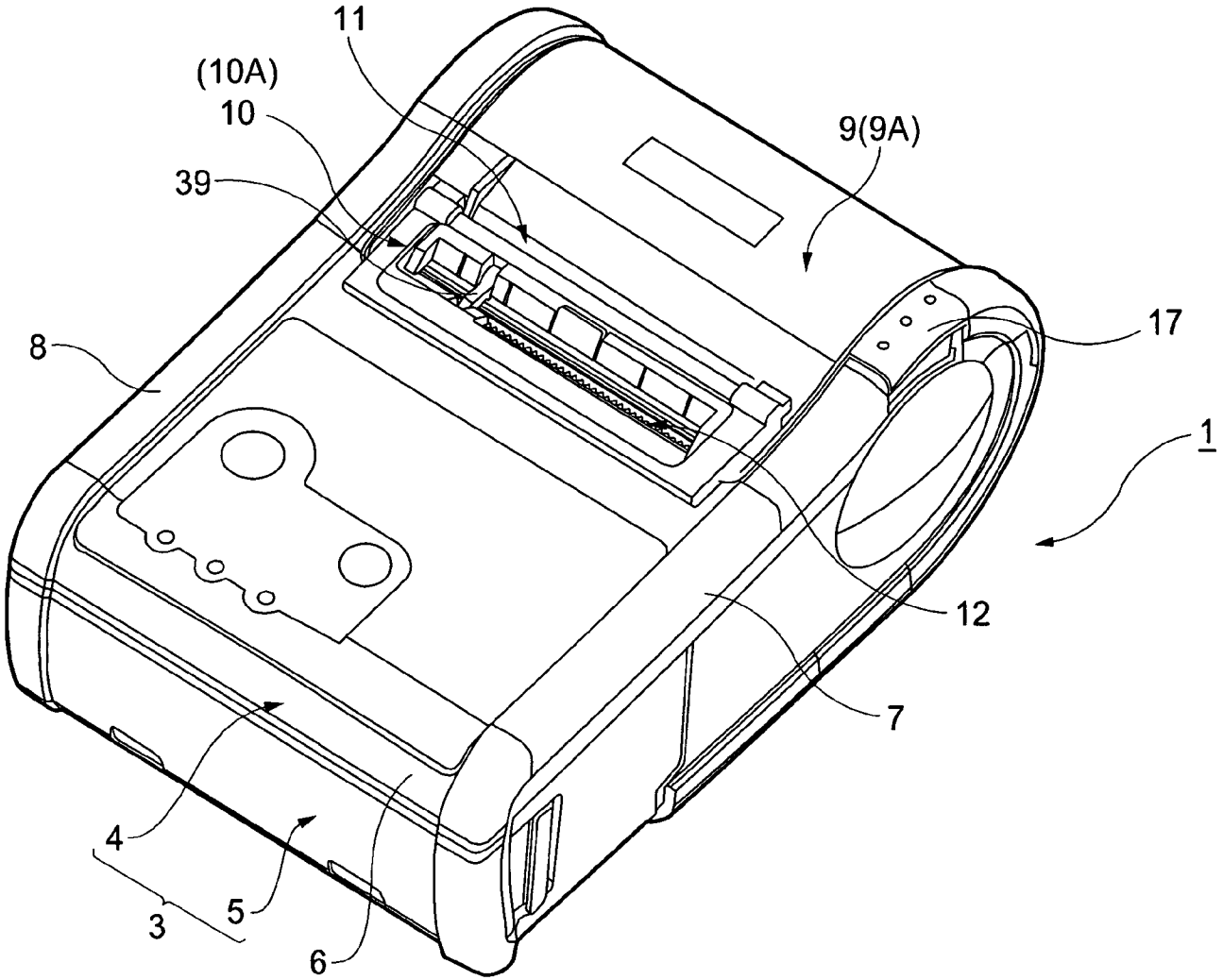
FIG. 1 is an external oblique view of a printer with a peeler mechanism according to the present invention.

A printer with a peeler mechanism 1 according to this embodiment of the invention has a relatively flat, box-like shape, preferably in a rectangular configuration, as shown in FIG. 1 that is longer from front to back than across the width. The printer is composed of a printer body 2 (defining a printer mechanism, see FIG. 2) and a printer case 3 covering the printer body 2.

Figure 2:
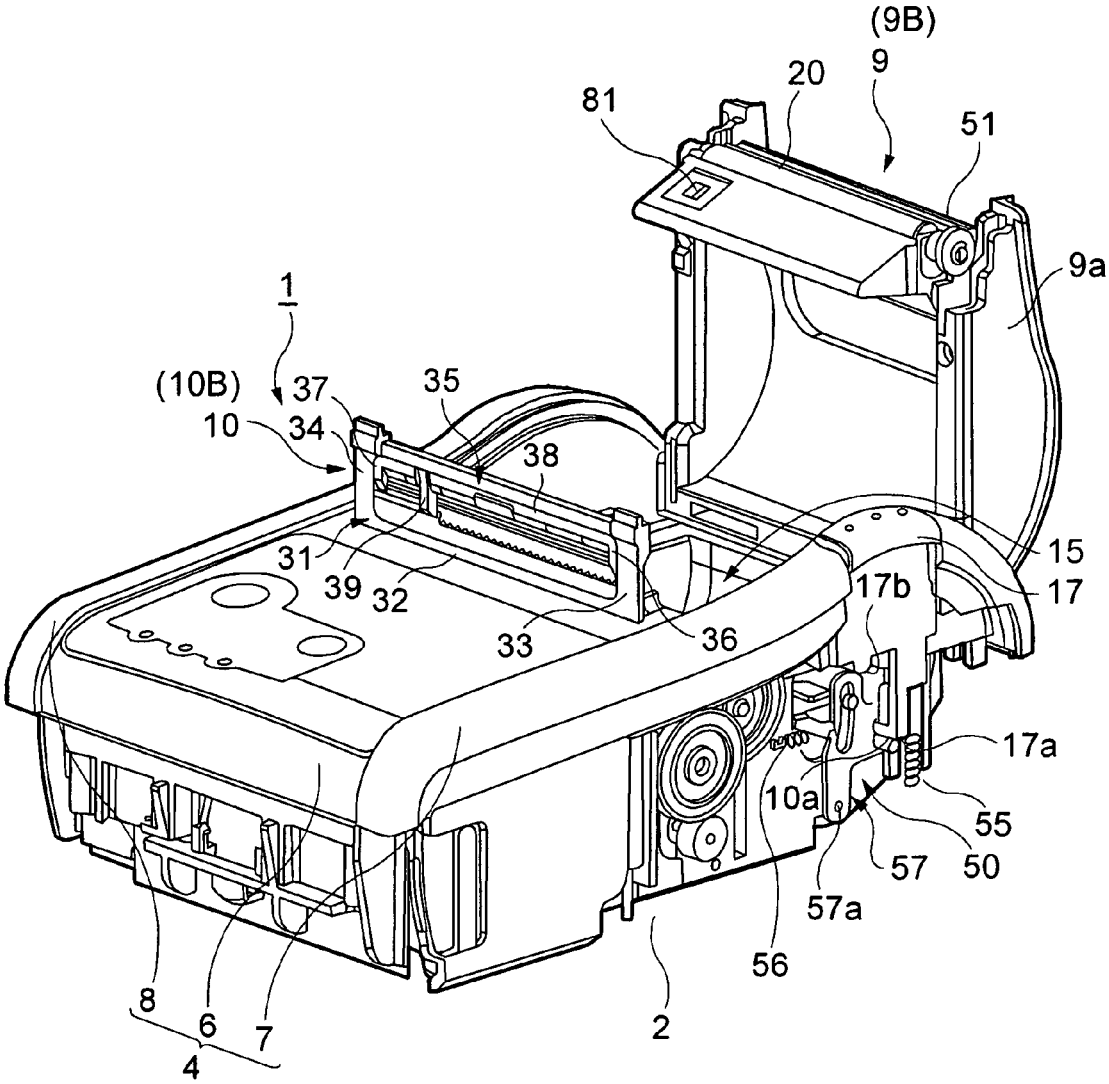
FIG. 2 is an external oblique view showing the printer in FIG. 1 with the opening/closing cover open.

The printer case 3 is composed of a top portion 4 and a bottom portion 5. FIG. 2 shows the printer with a peeler mechanism 1 with the bottom portion 5 removed. The top portion 4 of the printer body 2 is composed of a top front case portion 6 that covers the front top part of the printer, and right and left side case portions 7 and 8. An opening/closing cover 9 that opens and closes is disposed at the top rear portion of the printer. A peeler unit 10 that opens and closes is disposed in front of the opening/closing cover 9, and a web exit 11 is rendered widthwise to the printer between the opening/closing cover 9 and peeler unit 10. A label exit 12 for dispensing printed labels is rendered to the peeler unit 10 widthwise to the printer.

Figure 3:
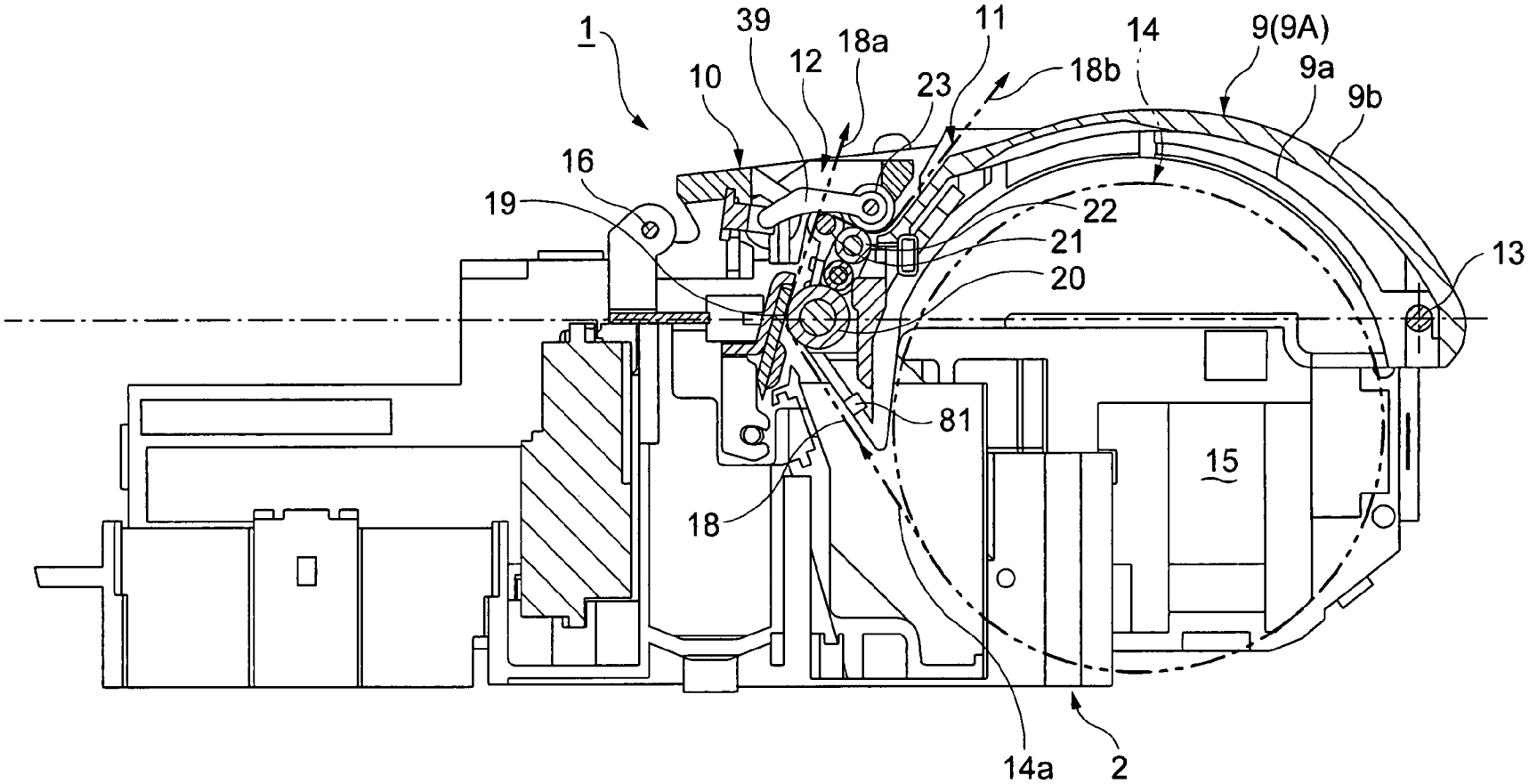
FIG. 3 is a schematic section view showing the transportation paths of the roll paper, web, and labels in the printer shown in FIG. 1.

As shown in FIG. 3, the opening/closing cover 9 is composed of cover frame 9*a* and a curved cover panel 9*b* that covers the curved top portion of the cover frame 9*a*. The back end part of the cover frame 9*a* is pivotally supported by a pivot shaft 13 extending widthwise to the printer on the printer body 2. The opening/closing cover 9 can pivot between the closed position 9A shown in FIG. 1 and the open position 9B in which the opening/closing cover 9 stands upright as shown in FIG. 2. Opening the opening/closing cover 9 opens the paper compartment 15 formed in the back part of the printer body 2 to hold the paper roll 14.

The peeler unit 10 is similarly pivotally supported at the front end thereof on a pivot shaft 16 disposed to the printer body 2 extending widthwise to the printer. The peeler unit 10 can thus also swing from the closed position 10A shown in FIG. 1 to the open position 10B in which the peeler unit 10 stands upright as shown in FIG. 2.

The opening/closing cover 9 and peeler unit 10 are locked in the closed position by an opening/closing mechanism 50 shown in FIG. 7 and described below. Operating a cover release button 17 (a manual operating member) rendered on the right case portion 7 releases the opening/closing mechanism 50 so that the opening/closing cover 9 and peeler unit 10 can be opened.

A transportation path 18 is rendered inside the printer body 2 for conveying roll paper 14*a* delivered from the paper roll 14 held in the paper compartment 15 as denoted by the double-dot dash line in FIG. 3 to the web exit 11 and label exit 12 formed in the top center portion of the printer. A thermal head 19 is disposed in the middle of this transportation path 18. A platen roller (a paper feed roller) 20 disposed on the opening/closing cover 9 side is pressed with specific force from the back side of the printer to the printing surface of the thermal head 19. The roll paper 14*a* is conveyed while held between the thermal head 19 and platen roller 20 and is printed in contact with the thermal head 19. The printed roll paper 14*a* is then separated by the peeler mechanism into a label 14*c* and the web 14*b* (see FIG. 5A), and the label 14*c* is conveyed through transportation path 18*a* and discharged from label exit 12 while the web 14*b* is conveyed through transportation path 18*b* and discharged from the web exit 11.

A label position sensor 81 composed of a reflective photosensor is disposed to the transportation path 18. The reflectivity of the label 14*c* is relatively high while the reflectivity of the web 14*b* is relatively low. The location of the label 14*c* can thus be determined by comparing the reflectivity of light detected by the label position sensor 81 from the label 14*c* and the web 14*b* portions of the roll paper 14*a*. The printer with a peeler mechanism 1 can thus print to a specific location on the label 14*c*.

A peeler roller 21 disposed to the transportation path 18*b* leading to the web exit 11 bends the roll paper 14*a* in a substantially acute angle and peels the label 14*c* from the web 14*b*. A web transportation roller 22 assembled to the printer body 2 is disposed behind the peeler roller 21. A pressure roller 23 disposed to the peeler unit 10 is pressed against and rotates in conjunction with the web transportation roller 22, and the web 14*b* is thus held between the web transportation roller 22 and pressure roller 23. The web transportation roller 22 turns synchronized with the platen roller 20 to convey the web 14*b*.

The pressure roller 23 is assembled to the peeler unit 10, the peeler roller 21 and web transportation roller 22 are assembled to the printer body 2, and these rollers combine to form the peeler mechanism. Opening the peeler unit 10 separates the pressure roller 23 disposed to the peeler unit 10 from the web transportation roller 22, and thus opens the transportation path 18*b* guiding the web 14*b* to the web exit 11 after the label is printed. Opening the opening/closing cover 9 likewise separates the platen roller 20 attached thereto from the thermal head 19, and thus opens the transportation path 18.

Peeler Mechanism

FIG. 4A, FIG. 4B, FIG. 5A, FIG. 5B, and FIG. 6 are descriptive diagrams showing the peeler mechanism portion of the printer. The arrangement and operation of a peeler mechanism according to this embodiment of the invention are described next with reference to these figures.

The peeler unit 10 has a unit frame 31. This unit frame 31 has a connecting portion 32 extending widthwise to the printer, and left and right arm portions 34, 33 extending in the front-back direction of the printer at opposite ends of the connecting portion 32 as shown in FIG. 2. A shaft hole 33*a*, 34*a* is formed in the front end part of each arm portion 33, 34. Pivot shaft 16 rendered on the printer body 2 side passes freely rotatably through the shaft holes 33*a*, 34*a* so that the unit frame 31 can rotate open and closed on pivot shaft 16. As described above, the unit frame 31 can pivot open and closed between the closed position 10A shown in FIG. 1 and the open position 10B shown in FIG. 2.

An opening and closing pressure roller support frame 35 that supports the pressure roller 23 is attached to the unit frame 31. This pressure roller support frame 35 has left and right pivot arms 37, 36 extending in the front-back direction of the printer. A connecting portion 38 extending widthwise to the printer connects the end portions of these pivot arms 37, 36 at the back side of the printer, and the pressure roller 23 is rendered freely rotatably below the connecting portion 38 between the pivot arms 37, 36. The end parts of the pivot arms 37, 36 at the front side of the printer are attached to pivot freely up and down to the left and right arm portions 34, 33 of the unit frame 31. The pressure roller support frame 35 can pivot from an operating position 35A pressing the pressure roller 23 to the web transportation roller 22 on the printer side as shown in FIG. 4A and FIG. 5A, to the retracted position 35B rotated substantially 180 degrees to the front of the printer as shown in FIG. 6.

Figure 4A:
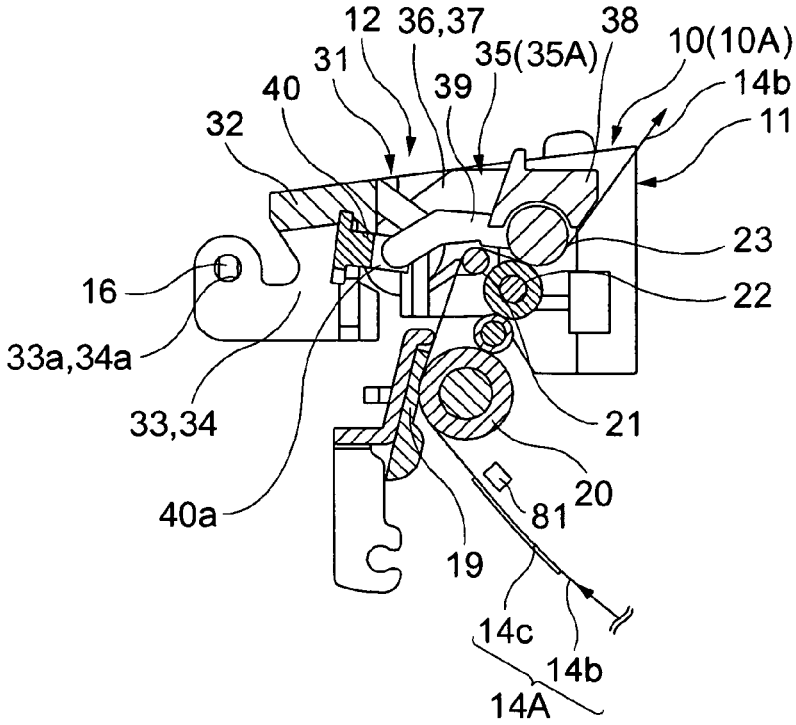
FIG. 4A describes the operation of the peeler mechanism portion of the printer shown in FIG. 1.
Figure 5A:
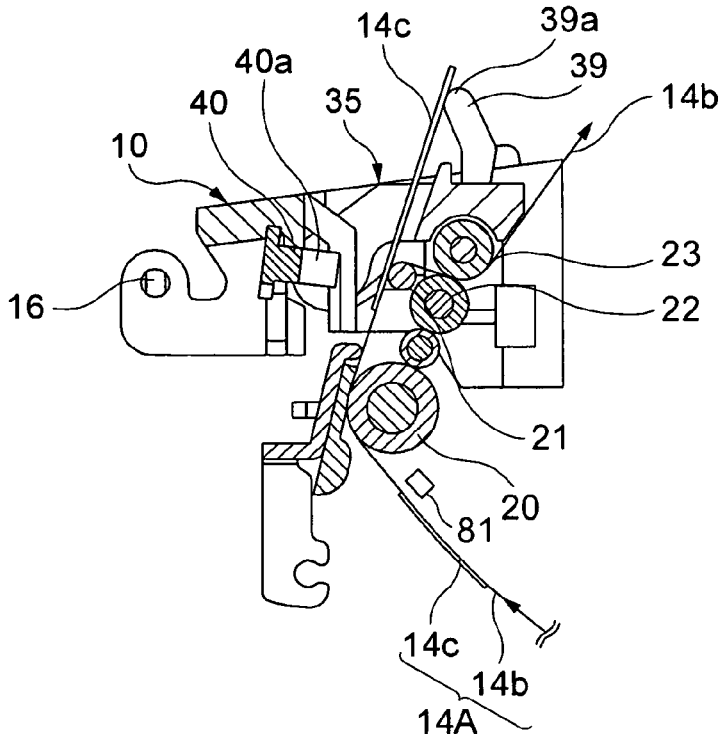
FIG. 5A describes the operation of the peeler mechanism portion of the printer shown in FIG. 1.
Figure 6:
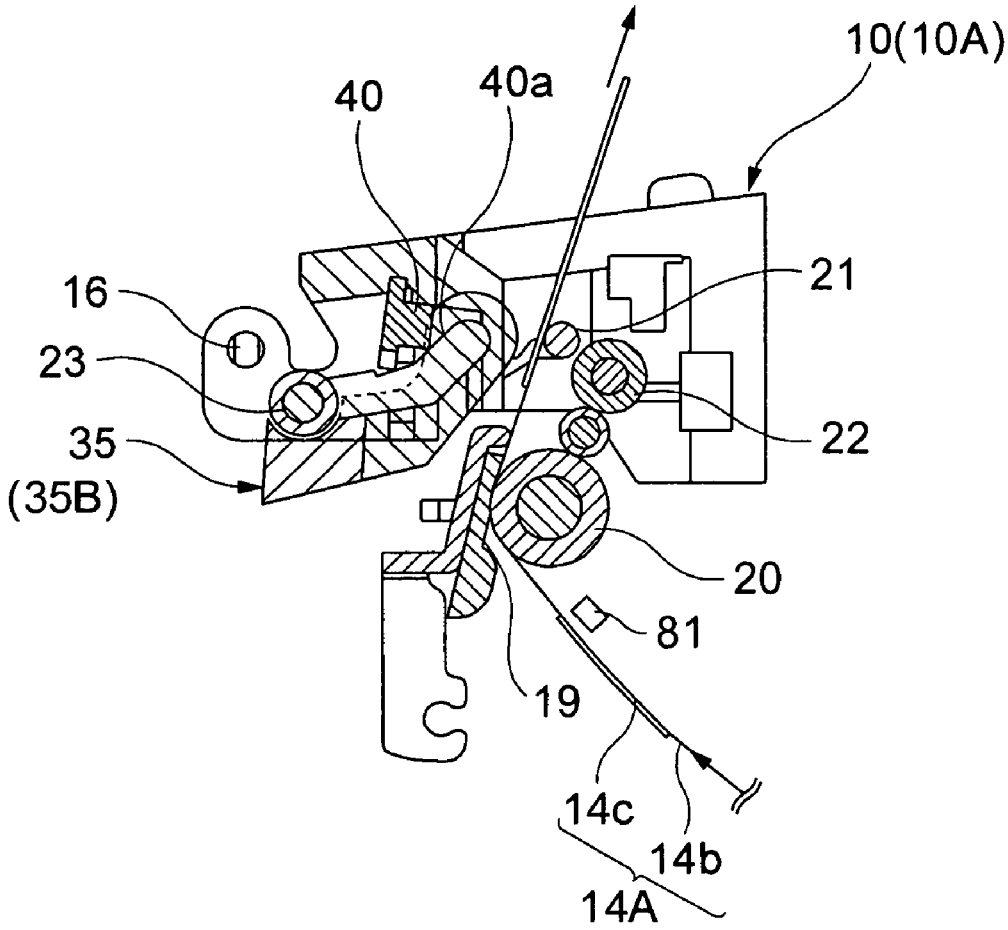
FIG. 6 describes the operation of the peeler mechanism portion of the printer shown in FIG. 1.

As also shown in FIG. 4A and FIG. 5A, a label detection lever 39 that pivots freely around the rotational axis of the pressure roller 23 is attached to the pressure roller support frame 35. This label detection lever 39 is held with a weak urging force in a position closing the label exit 12 as shown in FIG. 4A, is pushed up by the label 14*c* being discharged to the label exit 12, and thus pivots up and retracts away from the label exit 12 as shown in FIG. 5A.

A photosensor 40 for detecting the presence of a label in the label exit 12 by detecting the position of the label detection lever 39 is disposed to the connecting portion 32 of the unit frame 31. The distal end 39*a* of the label detection lever 39 is positioned in the detection range 40*a* (the nonexistence of a label in the label exit 12). When the label detection lever 39 pivots (the presence of a label in the label exit 12), the distal end 39*a* is no longer detected by the photosensor 40, and the photosensor 40 thus outputs a label detection signal.

Operation of the peeler mechanism thus arranged is described next. Labels can be dispensed either one at a time or continuously as described more fully below. In either case, however, label paper 14A having labels 14*c* of a specific length affixed at a specific interval to a long web 14*b* wound in paper roll 14 is held in a roll in the paper compartment 15.

To issue (print) labels 14*c* one at a time, the web 14*b* is fed as shown in FIG. 4A around the peeler roller 21, between the web transportation roller 22 and pressure roller 23, and out from the web exit 11. When the label paper 14A is conveyed through the transportation path 18, the web 14*b* is discharged from the web exit 11 but the stiffness of the label 14*c* affixed to the web 14*b* causes each label 14*c* to continue in a straight line at the peeler roller 21 instead of curving with the web 14*b* acutely around the peeler roller 21. The label 14*c* thus peels away from the surface of the web 14*b* and proceeds upward to the label exit 12.

As shown in FIG. 5A, the label 14*c* is discharged while pushing the label detection lever 39 up away from the position closing the label exit 12. This causes the distal end 39*a* of the label detection lever 39 to leave the detection range 40*a* of the photosensor 40, and the photosensor 40 thus outputs the label detection signal. That a label has been dispensed from the label exit 12 is thus detected, conveying the label paper 14A stops, and the printer waits for the label 14*c* to be removed. When the user removes the label 14*c*, the label detection lever 39 returns to the closed position shown in FIG. 4A, photosensor 40 output changes, and it is thus detected that the label 14*c* was removed. The label discharge operation of conveying the label paper 14A and printing can then resume. By repeating this operation, labels 14*c* are issued (printed) one at a time as the operator removes each dispensed label.

Figure 4B:
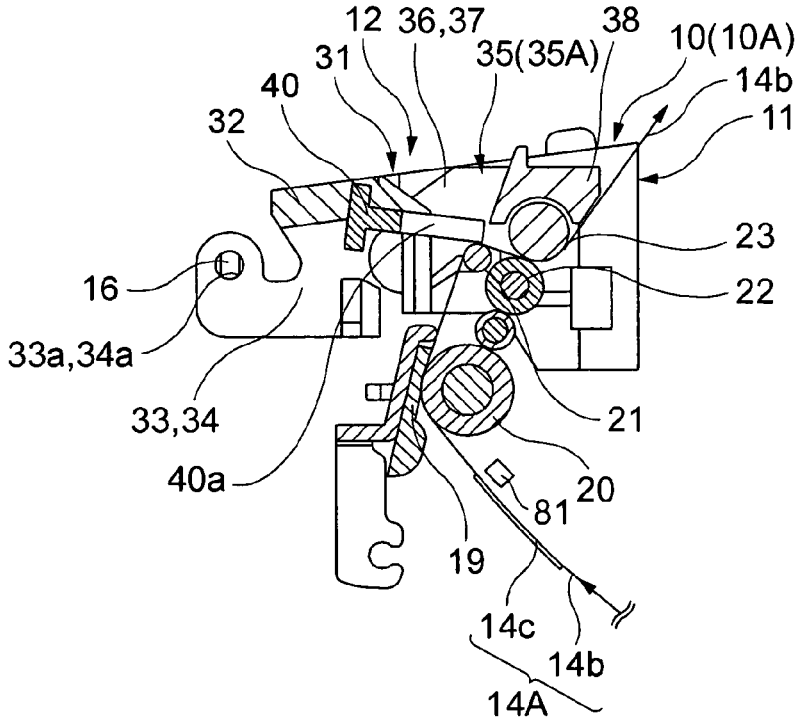
FIG. 4B describes operation when only a photosensor is used in FIG. 4A.
Figure 5B:
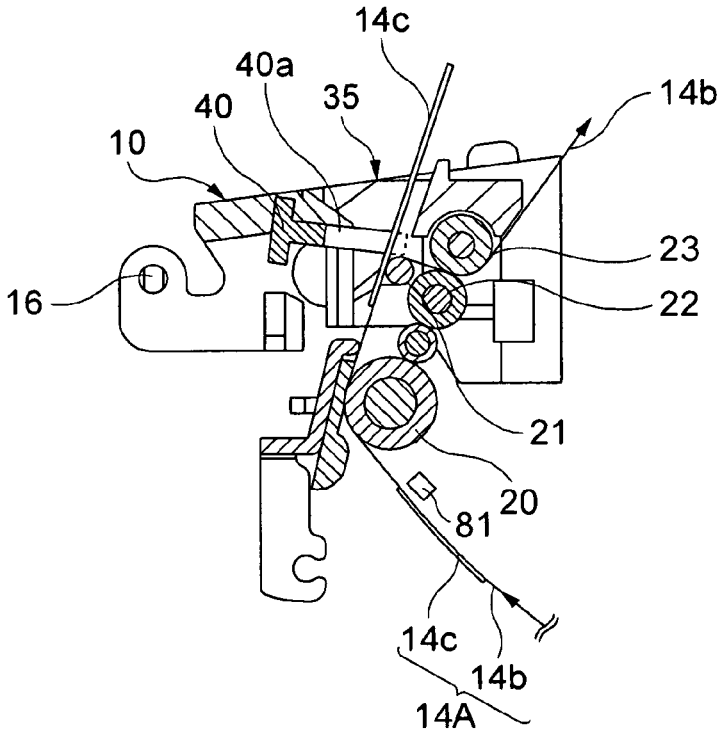
FIG. 5B describes operation when only a photosensor is used in FIG. 5A.

FIG. 4B and FIG. 5B show an alternative arrangement in which the presence of a dispensed label 14*c* in the label exit 12 is detected using only the photosensor 40, that is, without using the foregoing label detection lever 39. The light emitted by the photosensor 40 is not reflected back by the label 14*c* when a label 14*c* is not present in the detection range 40*aa* as shown in FIG. 4B, but the light is reflected when the label 14*c* is in the detection range 40*aa* as shown in FIG. 5B. Photosensor 40 output thus changes according to whether a label 14*c* is present, and the presence of a label 14*c* in the detection range 40*a* is detected from this difference in photosensor 40 output. If the distance between the photosensor 40 and label 14*c* is great, a photosensor 40 having a lens with a long focal length must be used.

The operation for outputting a continuous series of labels 14*c* is described next and shown in FIG. 6.

When a continuous series of labels is output intact on the web, the pressure roller support frame 35 is rotated from the operating position 35A to the retracted position 35B and the label paper 14A is fed passing out from the label exit 12. As described above, the label detection lever 39 detection range of the photosensor 40 is positioned at the pivot point of the pressure roller support frame 35. As a result, the distal end 39*a* of the label detection lever 39 remains in the detection range 40*a* of the photosensor 40 even when the pressure roller support frame 35 is rotated to the retracted position 35B. The label detection lever 39 is always away from the position closing the label exit 12. The label detection signal is therefore not output from the photosensor 40 and the label detection operation is disabled. That is, the label detection signal doesn't change.

If as described in FIG. 4B and FIG. 5B the label detection lever 39 is not used and only the photosensor 40 is used, the presence of the label paper 14A in the detection range 40*a* is detected continuously. To prevent the mis-detection, the operator can operate a switch not shown to cause the printer with a peeler mechanism 1 to recognize that labels 14*c* are being dispensed continuously, thereby enabling the same operation illustrated in FIG. 6. In this case, the printer does not detect by the photosensor 40.

The labels 14*c* on the web 14*b* can thus be printed continuously without interrupting transportation of the label paper 14A, and the printed labels 14*c* can remain affixed to the web 14*b* and issued (printed) continuously from the label exit 12.

When printing to a paper roll 14 having roll paper 14*a* wound in a roll, the pressure roller support frame 35 is generally rotated to the retracted position 35B and the roll paper 14*a* is loaded exiting from the label exit 12. In this case the leading end of the printed roll paper 14*a* is discharged continuously from the label exit 12 in the same way as when labels are issued continuously intact on the web. This is the same as the printing operation of a printer that prints to common roll paper (that is, roll paper that is not label paper for printing labels).

Opening and Closing Mechanism

The opening/closing cover 9 and peeler unit 10 are locked in the closed position by the opening/closing mechanism 50. Operating the cover release button 17 (see FIG. 1) disposed on the side of the printer case 3 causes the opening/closing mechanism 50 to unlock the opening/closing cover 9 and peeler unit 10. When the opening/closing cover 9 is thus unlocked, the opening/closing cover 9 is pushed up a certain distance in the opening direction from the closed position. When the opening/closing cover 9 is thus pushed up it is completely released from the printer body 2, and the urging force of a torsion spring or other urging member not shown that urges the opening/closing cover 9 to the open position causes the opening/closing cover 9 to automatically swing open to the open position 9B shown in FIG. 2.

When the peeler unit 10 is unlocked, a torsion spring or other urging member not shown that urges the peeler unit 10 to the open position 10B likewise causes the peeler unit 10 to automatically pivot open to the open position 10B shown in FIG. 2.

Figure 7:
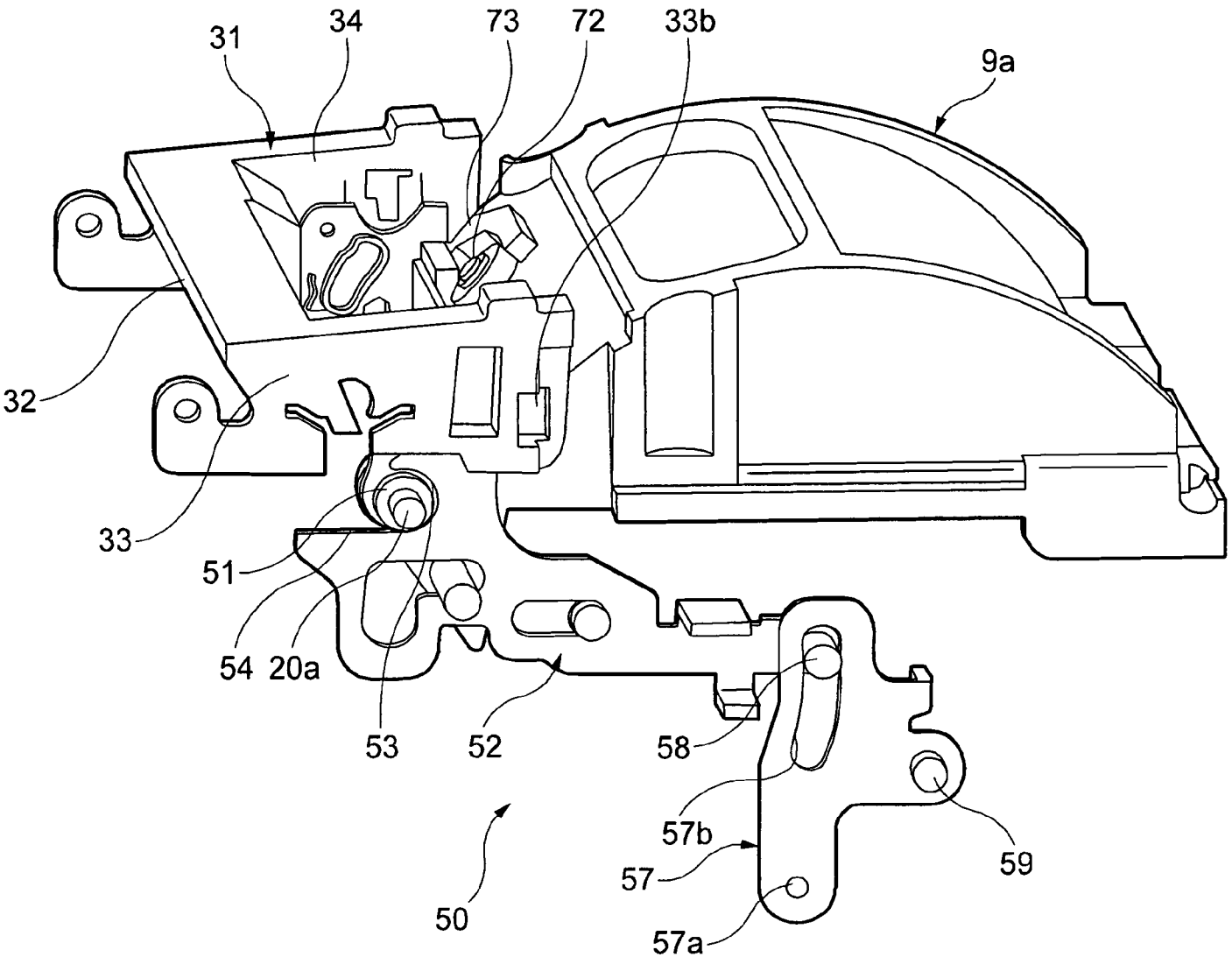
FIG. 7 is an oblique view showing the basic components of the opening/closing mechanism of the printer shown in FIG. 1.
Figure 8:
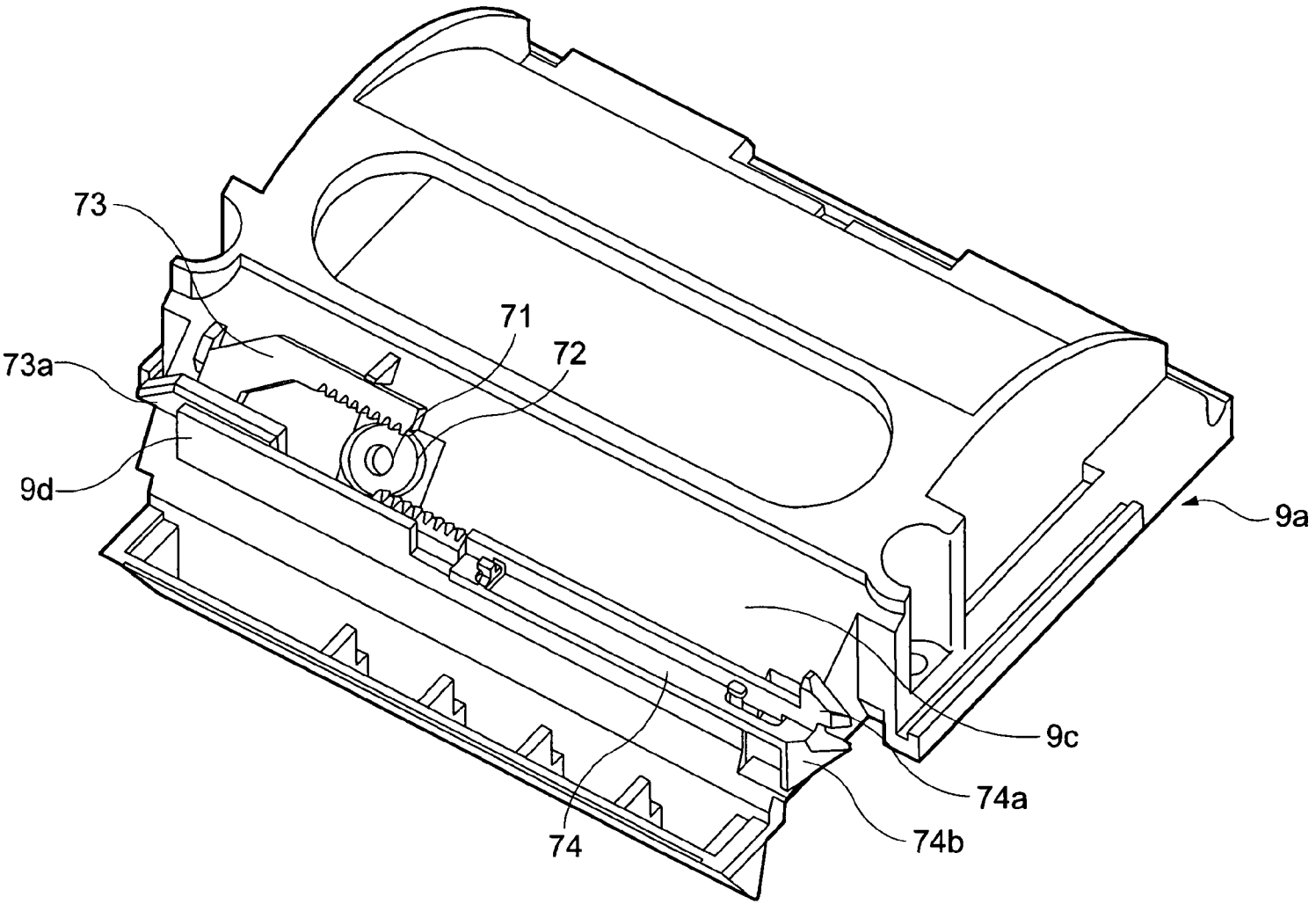
FIG. 8 is an oblique view showing the portion on the side of the opening/closing cover in FIG. 7.

FIG. 7 is an oblique side view showing the main basic elements of the opening/closing mechanism 50, FIG. 8 is an oblique view of the opening/closing cover 9 as seen from the front, and FIG. 9 to FIG. 12 describe the operation of the opening/closing mechanism 50. The arrangement of the opening/closing mechanism 50 is described next with reference to FIG. 2 and FIG. 7 to FIG. 12.

The parts of the opening/closing mechanism 50 for opening and closing the opening/closing cover 9 are described first below. A cylindrical cover-side engaging portion 51 is freely rotatably attached to the roller shaft 20*a* of the platen roller 20 disposed to the opening/closing cover 9. A lock lever 52 (a first locking member) is attached extending in the front-back (longitudinal) direction of the printer on the right side of the printer body 2 (see FIG. 2). A substantially semicircular engaging channel 53 that opens to the front of the printer is formed at the front top end portion of the lock lever 52. A cover-lifting surface 54 extending horizontally to the front is formed continuously to the bottom end of the circular inside surface of the engaging channel 53. The opening/closing cover 9 is locked when the cover-side engaging portion 51 of the opening/closing cover 9 is fit engaged in the engaging channel 53 of the lock lever 52 as shown in FIG. 7 and FIG. 9.

Figure 9:
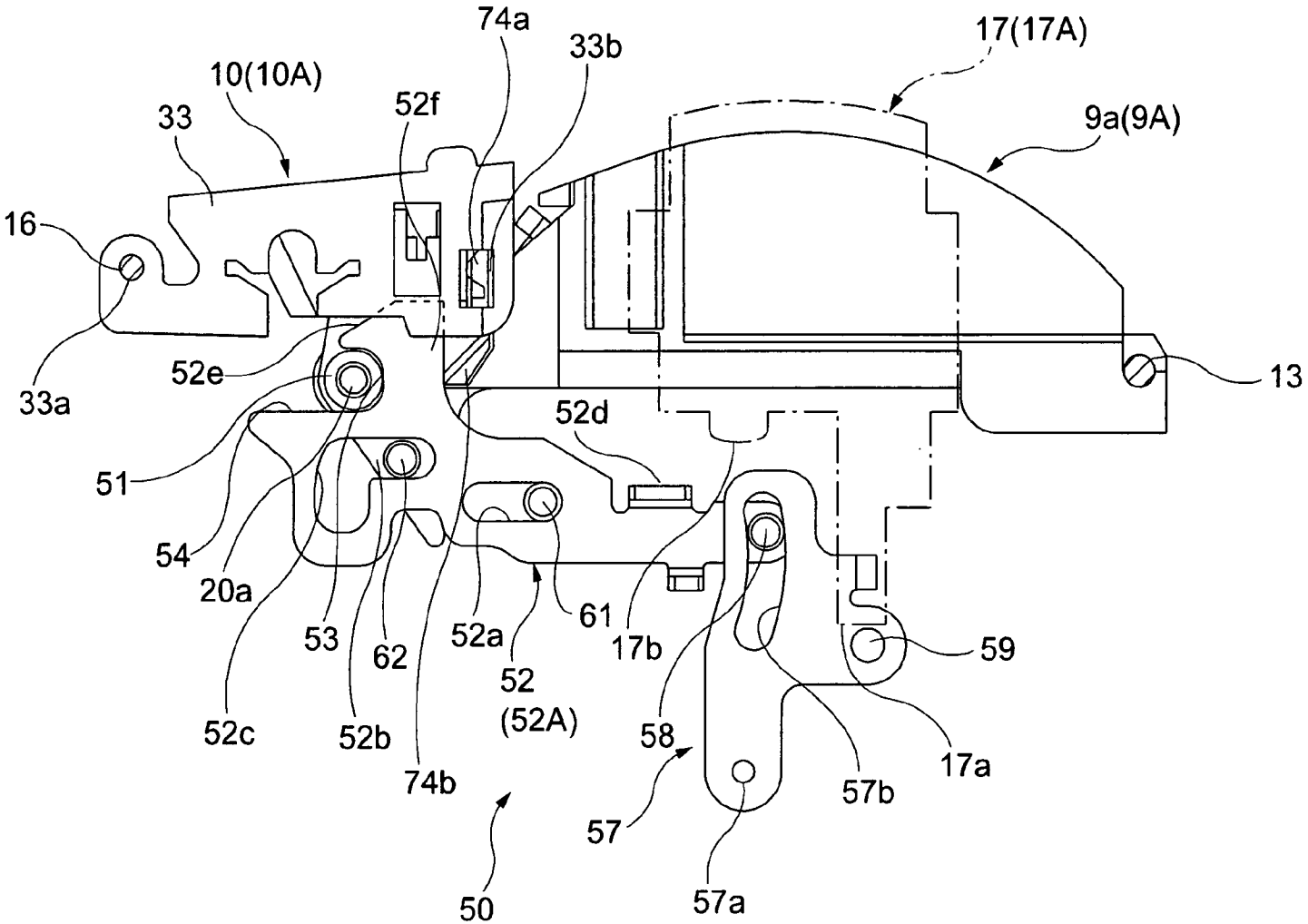
FIG. 9 describes the operation of the opening/closing mechanism.
Figure 10:
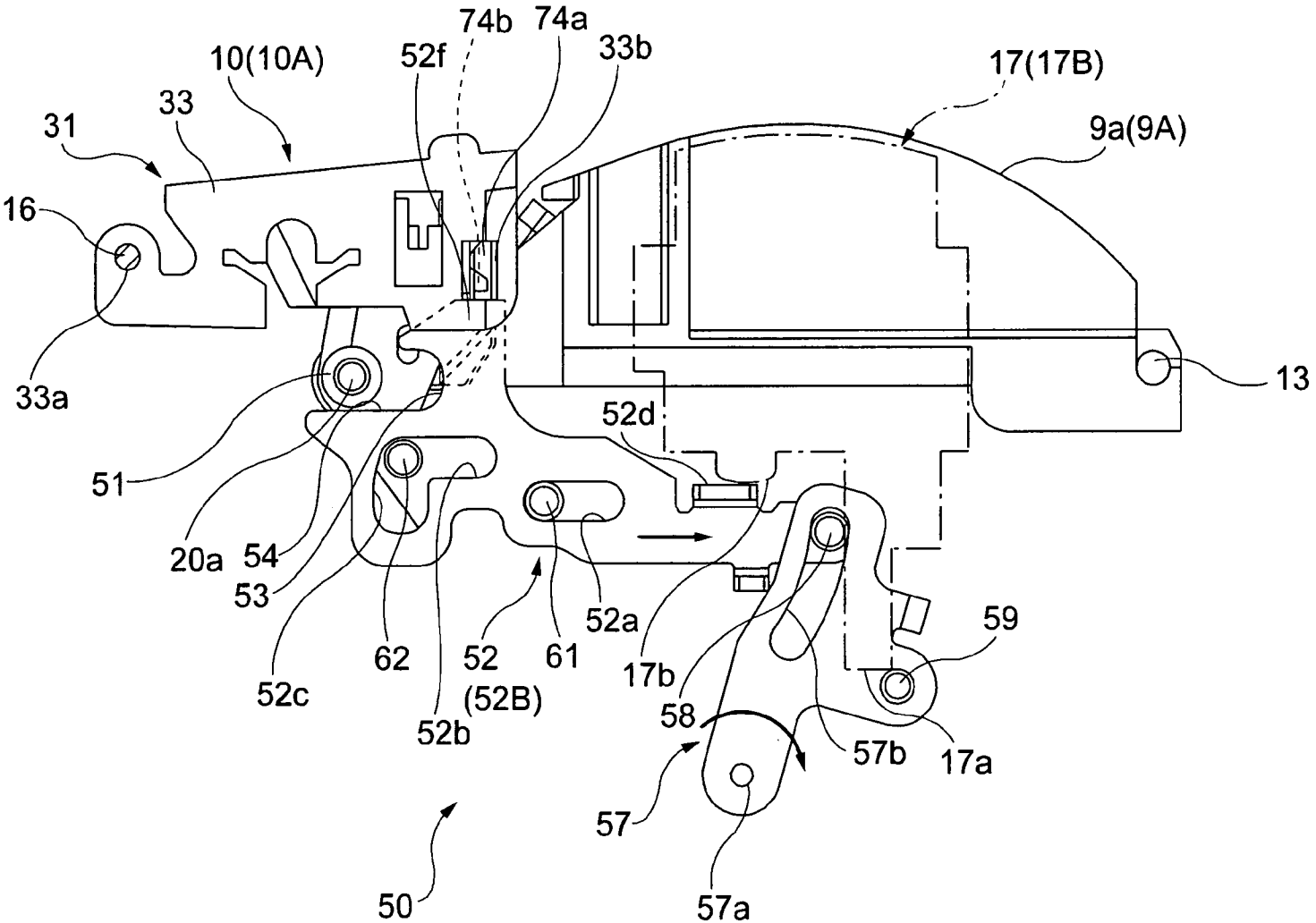
FIG. 10 describes the operation of the opening/closing mechanism.
Figure 11:
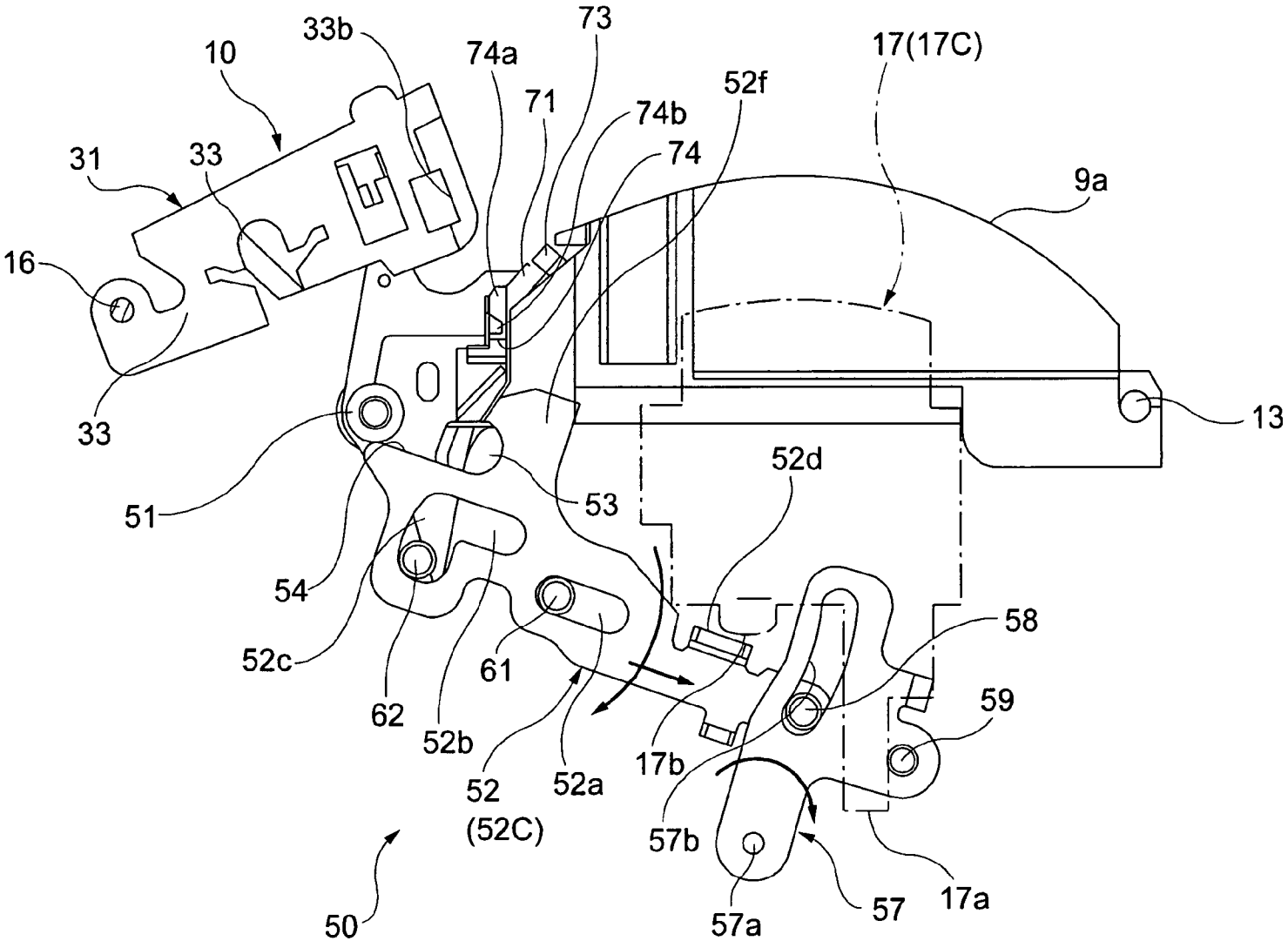
FIG. 11 describes the operation of the opening/closing mechanism.

The lock lever 52 can slide linearly in the front-back direction of the printer between the locked position 52A shown in FIG. 9 in which the cover-side engaging portion 51 of the opening/closing cover 9 in the closed position 9A is engaged in engaging channel 53, and the released position 52B shown in FIG. 10 in which the lock lever 52 is retracted a specific distance from this locked position 52A toward the back of the printer. The lock lever 52 can also swing (pivot) from the released position 52B to the lift position 52C in which the cover-lifting surface 54 pushes the cover-side engaging portion 51 up a specific distance as shown in FIG. 11. This operation of the lock lever 52 is linked to the cover release button 17 being pushed down.

When the cover release button 17 is depressed from the initial position 17A shown in FIG. 9 to the first operating position 17B shown in FIG. 10, the lock lever 52 slides from locked position 52A to released position 52B. When the cover release button 17 is then further depressed from this first operating position 17B to the second operating position 17C, which is the lowest position, shown in FIG. 11, the lock lever 52 swings to the lift position 52C.

A reset spring 55 shown in FIG. 2 continuously pushes the cover release button 17 upwards to the initial position 17A, and the cover release button 17 thus automatically returns to the initial position 17A when the downward pressure on the cover release button 17 is removed. The lock lever 52 is also constantly urged in the locking direction (52A) by a coil spring or other urging member 56 as shown in FIG. 2.

A swing arm 57 (a part of the linear movement mechanism and the pivot mechanism) disposed between the cover release button 17 and lock lever 52 converts the downward motion of the cover release button 17 to the sliding and swinging motion of the lock lever 52. This swing arm 57 pivots on a pivot pin 57*a* attached to the bottom end of the arm, and is attached to the printer body 2 so that the swing arm 57 can pivot after the lock lever 52 slides in the front-back direction of the printer. A curved pin guide hole 57*b* that is long in the vertical direction is formed at the top end portion of the swing arm 57. A link pin 58 fixed at the back end part of the lock lever 52 is inserted to the pin guide hole 57*b* so that the link pin 58 can both slide and rotate in the pin guide hole 57*b*.

An engagement pin 59 is also attached to the swing arm 57. This engagement pin 59 is located to the back of the pivot pin 57*a* at approximately the vertical center of the swing arm 57. A pushing-down surface 17*a* is formed on the distal bottom end of a vertical extension formed at the back side of the cover release button 17, and this pushing-down surface 17*a* is positioned above the engagement pin 59.

When the cover release button 17 is pushed down, the pushing-down surface 17*a* first contacts the engagement pin 59. As the cover release button 17 continues to descend, the pushing-down surface 17*a* pushes the engagement pin 59 down and causes the swing arm 57 to swing to the back pivoting on the pivot pin 57*a*. As the cover release button 17 is pushed down, the engagement pin 59 of the swing arm 57 traces a circular path around the pivot pin 57*a* and moves without separating from the pushing-down surface 17*a*. The engagement pin 59 is rendered in this embodiment of the invention so that it separates to the back of the printer from the pushing-down surface 17*a* when the cover release button 17 is depressed to further the first operating position 17B shown in FIG. 10.

First and second guide holes 52*a* and 52*b* that are straight ovals extending in the front-back direction of the printer are also formed in lock lever 52. First and second guide pins 61 and 62 disposed to the printer body 2 are slidably inserted in these first and second guide holes 52*a* and 52*b*. The first guide hole 52*a* is formed approximately in the lengthwise center of the lock lever 52, and the second guide hole 52*b* is formed in front of and slight above the first guide hole 52*a*. The lock lever 52 is held horizontally on the two guide pins 61 and 62. And, the lock lever 52 can be slided horizontally lengthwise to the printer.

A curved guide hole 52*c* extends continuously downward from the front end of second guide hole 52*b* so that the lock lever 52 can pivot on the first guide pin 61 positioned at the front end of first guide hole 52*a*. The curved pin guide hole 57*b* in the swing arm 57 is also curved so that the lock lever 52 can pivot on the first guide pin 61 positioned at the front end of the first guide hole 52*a* as shown in FIG. 10.

A flat contact surface 52*d* is rendered to the lock lever 52 between the first guide hole 52*a* and the link pin 58 disposed to the back end portion of the lock lever 52. A curved pushing-down surface 17*b* is rendered projecting downward from the front bottom end portion of the cover release button 17 so that the pushing-down surface 17*b* is positioned above the contact surface 52*d*.

When the cover release button 17 is depressed to further the first operating position 17B in this embodiment of the invention, the engagement pin 59 separates from the pushing-down surface 17*a* and pushing-down surface 17*b* contacts the contact surface 52*d*. When the cover release button 17 is depressed to further, the cover release button 17 pushes down the contact surface 52*d*. This causes the lock lever 52 to pivot on the first guide pin 61 inserted to first guide hole 52*a* so that the front end of the lock lever 52 rises.

An inclined guide surface 52*e* (see FIG. 9) sloping upward to the back continuously from the top end of the inside surface of the engaging channel 53 is rendered at the top of the engaging channel 53 in lock lever 52. When the lock lever 52 is in the locked position 52A and opening/closing cover 9 is closed from the open position, the cover-side engaging portion 51 moves in contact with the incline of the inclined guide surface 52*e* so that the cover-side engaging portion 51 is positioned and engaged with the engaging channel 53.

The components of the opening/closing mechanism 50 for opening and closing the peeler unit 10 are described next with reference to FIG. 8. A pinion shaft 71 is fixed at the front end portion 9*c* of the curved top surface of the cover frame 9*a* of the opening/closing cover 9. A pinion 72 is freely rotatably supported on this pinion shaft 71. A top rack 73 and a bottom rack 74 (second locking members) extending parallel to the widthwise direction of the printer mesh with this pinion 72.

The top rack 73 and bottom rack 74 are supported slidably widthwise to the printer by a slide guide 9*d* which also extends widthwise to the printer and is rendered in unison with the front end of the cover frame 9*a*. Tapered engaging claws 73*a*, 74*a* having a narrow tip are formed at the outside ends of the top rack 73 and bottom rack 74 widthwise to the printer. The top surface of engaging claws 73*a*, 74*a* is an incline sloping downward to the outside widthwise to the printer. An engaging claw 74*b* having an inclined surface sloping to the outside from the front to the back of the printer is rendered to the outside end of the bottom rack 74 below engaging claw 74*a*. A spring or other urging means not shown drives the pinion 72 so that the top rack 73 and bottom rack 74 are both pushed to the outside widthwise to the printer.

As shown in FIG. 9, engaging holes 33*b* and 34*b* (engaging hole 34*b* not shown) are formed at a position towards the back side of the printer in the arm portions 33, 34 of the unit frame 31 of the peeler unit 10. The engaging claw 74*a* of the bottom rack 74 and the engaging claw 73*a* of the top rack 73 pass from the inside to the outside through these engaging holes 33*b* and 34*b*. The peeler unit 10 is locked when these engaging claws 73*a*, 74*a* thus engage the engaging holes 33*b* and 34*b*.

When the peeler unit 10 is thus locked, the engaging claw 74*b* on the bottom of the bottom rack 74 is positioned below arm portion 33, and the top portion 52*f* of lock lever 52 is located in front. When the lock lever 52 then slides from this locked position 52A to the back, the top portion 52*f* first contacts the engaging claw 74*b*. When the lock lever 52 continues sliding to the back after the top portion 52*f* thus contacts the engaging claw 74*b*, the engaging claw 74*b* is forcibly pushed to the inside widthwise to the printer as the lock lever 52 slides along the incline of the engaging claw 74*b* of bottom rack 74. As the engaging claw 74*b* is thus pushed inside the lock lever 52, the engaging claw 74*a* above engaging claw 74*b* is disengaged from the engaging hole 33*b* in the arm portion 33. The pinion 72 causes the other top rack 73 to move in the opposite direction in conjunction with bottom rack 74, thereby disengaging engaging claw 73*a* from engaging hole 34*b* in arm portion 34, and thus unlocking the peeler unit 10.

Locking and Unlocking Operation

The locking and unlocking (releasing) operation of the opening/closing mechanism 50 is described next starting from the locked position of the opening/closing cover 9 and peeler unit 10 as shown in FIG. 7 and FIG. 9. When thus locked, the lock lever 52 is positioned in the forward locked position 52A, and the cover-side engaging portion 51 of the opening/closing cover 9 is engaged in engaging channel 53. The engaging claws 73*a*, 74*a* of the top rack 73 and bottom rack 74 disposed to the opening/closing cover 9 are inserted to the engaging holes 33*b* and 34*b* in the arm portions 33, 34 of the peeler unit 10 from the inside, and the peeler unit 10 is thus locked in the closed position 10A.

When the cover release button 17 is operated from this position and depressed to the first operating position 17B shown in FIG. 10, pushing-down surface 17*a* of the cover release button 17 pushes on the swing arm 57 which thus swings to the back.

The swing arm 57 is linked to the back end portion of the lock lever 52 by a linking mechanism composed of the curved pin guide hole 57*b* and link pin 58, and the lock lever 52 is supported slidably in the longitudinal direction by the two guide pins 61 and 62. As a result, when the swing arm 57 swings to the back, the lock lever 52 slides horizontally to the back to the released position 52B, and the opening/closing cover 9 is thus unlocked. The cover-side engaging portion 51 disengages from the engaging channel 53 of lock lever 52 but remains resting on the cover-lifting surface 54.

When the lock lever 52 slides back, the top portion 52*f* contacts the bottom engaging claw 74*b* of the bottom rack 74 and thus pushes the engaging claw 74*b* to the inside. When the lock lever 52 is in the released position 52B, the engaging claw 74*b* is in contact with the inside surface of the lock lever 52. More specifically, the bottom rack 74 is pushed to the inside by lock lever 52, and the top engaging claw 74*a* is disengaged from the engaging hole 33*b* in the arm portion 33 of the peeler unit 10. Because the pinion 72 causes the other top rack 73 to slide in the opposite direction, the engaging claw 73*a* is also disengaged from the engaging hole 34*b* in the other arm portion 34. As a result, the peeler unit 10 is also unlocked. The peeler unit 10 then pivots through the position shown in FIG. 11 to the substantially upright open position 10B shown in FIG. 12.

When the cover release button 17 is then pressed further down, the pushing-down surface 17*a* is disengaged from the swing arm 57, the front pushing-down surface 17*b* of the cover release button 17 contacts the contact surface 52*d* of the lock lever 52, and the lock lever 52 swings vertically around the first guide pin 61. The cover-lifting surface 54 at the front end portion of the lock lever 52 thus lifts the cover-side engaging portion 51 resting thereon. As a result, when the cover release button 17 is depressed to the final (second) operating position 17C, the lock lever 52 swings to lift position 52C as shown in FIG. 11, and opening/closing cover 9 is raised a specific distance and completely released from the printer body 2.

Figure 12:
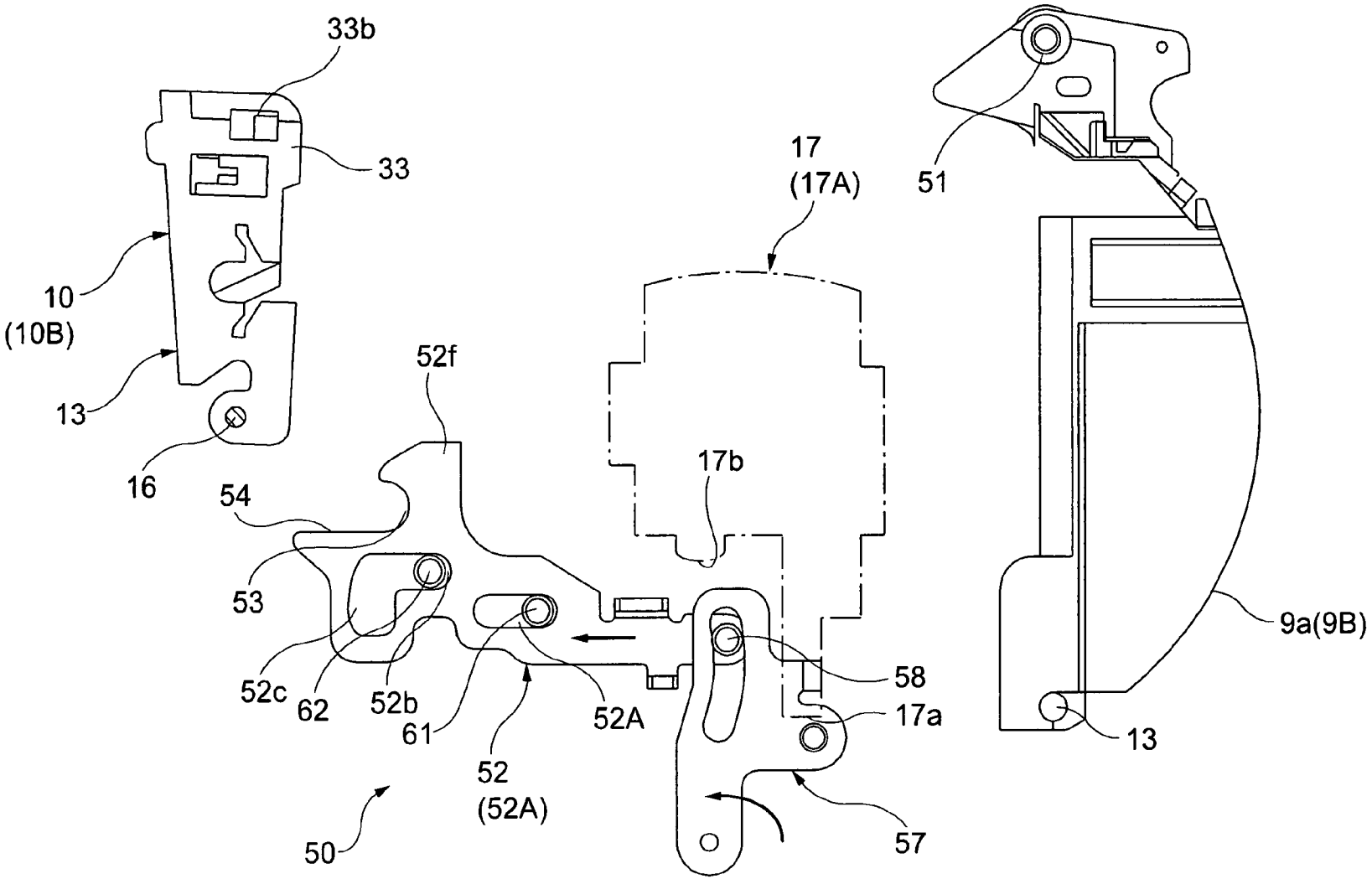
FIG. 12 describes the operation of the opening/closing mechanism.

The opening/closing cover 9 then opens automatically to the open position 9B. (When the opening/closing cover 9 is pushed up it is completely released from the printer body 2, and the urging force of a torsion spring or other urging member not shown that urges the opening/closing cover 9 to the open position causes the opening/closing cover 9 to automatically swing open to the open position 9B shown in FIG. 2.) When the downward pressure on the cover release button 17 is then released, reset spring 55 (see FIG. 2) pushes cover release button 17 up to the initial position 17A. The lock lever 52 is also returned by the urging force of urging member 56 from the raised (second operating) position 17C to the released (first operating) position 17B, and then slides into the locked (initial) position 17A. FIG. 12 shows the relative positions of the main components at this time.

When the opening/closing cover 9 is then closed again from the position shown in FIG. 12, the cover-side engaging portion 51 first contacts the inclined guide surface 52*e* of the lock lever 52 in locked position 52A. When the opening/closing cover 9 is then pressed down with greater force, the cover-side engaging portion 51 is pushed along the incline of the inclined guide surface 52*e*, and the lock lever 52 slides towards the released position 52B against the urging force of the urging member 56. Because the engaging channel 53 is contiguous to the bottom end of inclined guide surface 52*e*, the cover-side engaging portion 51 slides from the bottom end of the inclined guide surface 52*e* into the front of the engaging channel 53 as the lock lever 52 slides to the back, and the lock lever 52 slides forward to the locked position 52A. The opening/closing cover 9 is thus automatically locked when the opening/closing cover 9 is closed as a result of the inclined guide surface 52*e* rendered on the lock lever 52.

When the peeler unit 10 is then pushed down, the arm portions 33, 34 contact the engaging claws 74*a* and 73*a* of the bottom rack 74 and the top rack 73 and push the claws in as the arms swing down. When the peeler unit 10 reaches the closed position 10A, the engaging holes 33*b*, 34*b* of the arm portions 33, 34 are opposite the engaging claws 73*a* and 74*a* and the engaging claws 73*a* and 74*a* thus engage the engaging holes 33*b*, 34*b*. The peeler unit 10 is thus locked in the closed position.

The opening/closing mechanism 50 according to this embodiment of the invention thus unlocks the opening/closing cover 9 and lifts (opens) the unlocked opening/closing cover 9 as a result of the simple action of depressing the cover release button 17 while simultaneously also releasing the peeler unit 10.

The lock lever 52 also slides linearly forward and back between locked and unlocked (released) positions. In this embodiment of the invention the lock lever 52 slides in a direction substantially perpendicular (the horizontal) to the tangent line to the engagement position on the curved path of the cover-side engaging portion 51 of the opening/closing cover 9, and thus engages the cover-side engaging portion 51. That is, the cover-side engaging portion 51 is in the engaging channel 53 that is a deep hollow. A deeper engaging channel 53 can thus be formed than when using a locking lever that only swings in an arc, thus affording a stronger locking mechanism. Problems such as impact or vibration releasing the lock and allowing the opening/closing cover to open easily are thus prevented.

The roller shaft 20*a* of the platen roller 20 is also affixed to the cover-side engaging portion 51 in this embodiment of the invention. As a result, the position of the platen roller 20 when the opening/closing cover 9 is closed is directly controlled by the lock lever 52 of the opening/closing mechanism 50. The platen roller 20 can thus be precisely positioned and play in the platen roller 20 can be prevented.

Furthermore, the mechanism that locks the peeler unit 10 is rendered connectedly between the peeler unit 10 and opening/closing cover 9. The peeler unit 10 therefore cannot be locked in the closed position unless the opening/closing cover 9 is locked in the closed position, and forgetting to close the opening/closing cover 9 can thus be prevented. A single sensor for detecting the open and closed state of the peeler unit 10 can therefore be used to detect the open and closed state of both the peeler unit 10 and opening/closing cover 9.

The mechanism for locking the peeler unit 10 is composed of a pinion 72 and a pair of top and bottom racks 73, 74, and can firmly lock the peeler unit 10 without play in either direction widthwise to the printer. This mechanism is also extremely simple because moving and releasing one rack also releases the other rack.

This embodiment of the invention is described using a thermal printer by way of example, but the invention will obviously not be so limited and can be applied to inkjet printers and other types of printers.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer with a peeler unit having a peeling mechanism for peeling labels from a web of roll paper adapted to be stored in the printer comprising:

an opening/closing cover located in said printer spaced apart from said peeler unit that opens and closes a roll paper storage compartment located in the printer;

said peeler unit being rotatably connected to the printer for moving said peeler mechanism into an open or closed position with said peeler mechanism including a peeler roller adapted for peeling labels from the web when the peeler mechanism is in the closed position and having an exit in the printer for discharging said labels separate from an exit in the printer through which the web exits;

a locking mechanism for said cover and said peeler unit with said locking mechanism comprising a first lock member for locking the opening/closing cover into a closed position and a second lock mechanism for locking the peeler unit into a closed position;

a manual operating member connected to said locking mechanism such that said cover and said peeler unit unlock at one time in response to manual actuation of said operating member with said manual operating member having a first operating position and a second operating position with each operating position arranged in sequence; and a movement mechanism for controlling the opening of said cover and said peeler unit in synchronism with the movement of said manual operating member, with said movement mechanism being coupled to said first lock member and to said second lock member and being responsive to the manual operating member such that when said manual operating member is placed in said first operating position said movement mechanism disengages said first lock member for unlocking said peeler unit to disengage said peeler mechanism and when said manual operating member is then placed into said second operating position said movement mechanism disengages said second lock member for releasing said cover for opening said roll paper storage compartment.

2. A printer with a peeler mechanism as described in claim 1 wherein said movement mechanism comprises:

a pivot mechanism for pivoting the first lock member in response to movement of said manual operating member into said first operating position, and wherein said pivot mechanism is further pivoted in response to movement of said manual operating member into said second operating position and is coupled to said second lock member to unlock the peeler unit upon being further pivoted.

3. A printer with a peeler mechanism as described in claim 2, wherein the second lock member is disposed to the opening/closing cover to lock the peeler unit in the closed position when the opening/closing cover is locked in the closed position.

4. A printer with a peeler mechanism as described in claim 2, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

5. A printer with a peeler mechanism as described in claim 1, wherein the second lock member is disposed to the opening/closing cover to lock the peeler unit in the closed position when the opening/closing cover is locked in the closed position.

6. A printer with a peeler mechanism as described in claim 5, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

7. A printer with a peeler mechanism as described in claim 1, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

8. A printer with a peeler unit having a peeling mechanism for peeling labels from a web of roll pacer stored in the printer, comprising:

an opening/closing cover that opens and closes a roll paper storage compartment located in the printer;

said peeler unit being rotatably connected to the printer for moving said peeler mechanism into an open or closed position with said peeler mechanism including a peeler roller adapted for peeling labels from the web when the peeler unit is in the closed position and having an exit in the printer for discharging said labels separate from an exit in the printer through which the web exits;

a locking mechanism for said cover and said peeler unit with said locking mechanism comprising a first lock member for locking the opening/closing cover into a closed position and a second lock mechanism for locking the peeler unit into a closed position;

a manual operating member connected to said locking mechanism such that said cover and said peeler unit unlock at one time in response to manual actuation of said operating member and a linear movement mechanism responsive to said manual operating member for controlling the opening of said cover and said peeler unit in synchronism with the movement of the manual operating member, said linear movement mechanism being coupled to said first lock member and to said manual operating member for moving said first lock member linearly in a substantially straight line between positions for unlocking said cover and said peeler unit to disengage said peeler mechanism and for controlling the locking of the peeler unit and cover in response to manually closing said peeler unit and cover.

9. A printer with a peeler mechanism as described in claim 8, wherein the second lock member is disposed to the opening/closing cover to lock the peeler unit in the closed position when the opening/closing cover is locked in the closed position.

10. A printer with a peeler mechanism as described in claim 9, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

11. A printer with a peeler mechanism as described in claim 8, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

12. A printer with a peeler unit having a peeling mechanism for peeling labels from a web of roll paper stored in the printer comprising:

an opening/closing cover that opens and closes a roll paper storage compartment located in the printer;

said peeler unit being rotatably connected to the printer for moving said peeler mechanism into an open or closed position with said peeler mechanism including a peeler roller adapted for peeling labels from the web when the peeler unit is in the closed position;

a locking mechanism for said cover and said peeler unit with said locking mechanism comprising a first lock member for locking the opening/closing cover into a closed position;

a linear movement mechanism coupled to said first lock member; a second lock member for locking the peeler unit into a closed position;

a pivot mechanism coupled to both said first lock member and to said second lock member; and a manual operating member having a first operating position and a second operating position arranged in sequence;

wherein said linear movement mechanism controls the opening of said cover and said peeler unit in synchronism with the movement of the manual operating member;

wherein when the manual operating member moves to the first operating position, said linear movement mechanism linearly moves the first lock member to unlock the cover and the peeler unit and to disengage the peeler mechanism, and when the manual operating member moves from the first operating position to the second operating position, said pivot mechanism pivots the first lock member and moves the second lock member to open the cover.

13. A printer with a peeler mechanism as described in claim 12, wherein the second lock member is disposed to the opening/closing cover to lock the peeler unit in the closed position when the opening/closing cover is locked in the closed position.

14. A printer with a peeler mechanism as described in claim 12, further comprising: a pinion disposed to the opening/closing cover and being freely rotatably around a fixed point; and a pair of racks disposed to the opening/closing cover for linear reciprocal movement relative to one another when engaged with the pinion;

wherein the second lock member is composed of said pair of racks such that when said first lock member engages said one rack, the peeler unit is unlocked and released from the pair of racks.

* * * * *